US012043348B2

(12) United States Patent
Yuen

(10) Patent No.: US 12,043,348 B2
(45) Date of Patent: Jul. 23, 2024

(54) MOORING BUOY

(71) Applicant: Fiber Glass Systems, L.P., Dallas, TX (US)

(72) Inventor: Alex Yuen, Richmond (CA)

(73) Assignee: Fiber Glass Systems, L.P., Dover, TX (US)

( * ) Notice: Subject to any disclaimer, the term of this patent is extended or adjusted under 35 U.S.C. 154(b) by 155 days.

(21) Appl. No.: 17/820,698

(22) Filed: Aug. 18, 2022

(65) Prior Publication Data

US 2024/0059379 A1 Feb. 22, 2024

(51) Int. Cl.
*B63B 22/02* (2006.01)
*B63B 21/04* (2006.01)

(52) U.S. Cl.
CPC ..... *B63B 22/02* (2013.01); *B63B 21/04* (2013.01)

(58) Field of Classification Search
CPC ..... B63B 22/02; B63B 21/04
See application file for complete search history.

(56) References Cited

U.S. PATENT DOCUMENTS 3,598,275 A * 8/1971 Francois ..... B63B 3/13 428/113
5,509,838 A * 4/1996 Breivik ..... B63B 22/026 114/230.1
8,004,104 B2 * 8/2011 Hench ..... F03B 13/20 60/507

FOREIGN PATENT DOCUMENTS

| | | |
|---|---|---|
| CN | 212149207 | 12/2020 |
| GB | 856784 | 12/1960 |
| GB | 2393426 | 3/2004 |
| KR | 20130004443 | 1/2013 |
| WO | 2010126629 | 11/2010 |
| WO | 2024039979 | 2/2024 |

OTHER PUBLICATIONS

"International Application Serial No. PCT US2023 071682, International Search Report mailed Dec. 6, 2023", 3 pgs.
"International Application Serial No. PCT US2023 071682, Written Opinion mailed Dec. 6, 2023", 7 pgs.
"European Application Serial No. 23191842.6, Extended European Search Report mailed Feb. 1, 2024", 6 pgs.

* cited by examiner

*Primary Examiner* — S. Joseph Morano
*Assistant Examiner* — Jovon E Hayes
(74) *Attorney, Agent, or Firm* — Schwegman Lundberg & Woessner, P.A.

(57) ABSTRACT

A mooring buoy includes a cylindrical structural shell. The cylindrical structural shell includes fiberglass reinforced plastic (FRP) and has a first open end and an opposite second open end. A plurality of annular stiffeners are bonded to an inside of the cylindrical structural shell. A first endcap is disposed on the first open end of the cylindrical structural shell. The first endcap is configured to substantially cover the first open end. A second endcap is disposed on the second open end of the cylindrical structural shell. The second endcap is configured to substantially cover the second open end. At least one cylindrical attachment mechanism is coupled to an outside of the cylindrical structural shell. The cylindrical attachment mechanism is configured to attach mooring lines to the cylindrical structural shell.

20 Claims, 16 Drawing Sheets

MOORING BUOY

TECHNOLOGICAL FIELD

The present disclosure relates to mooring buoys for energy collection systems. More particularly, the present disclosure relates to mooring buoys manufactured of particular materials. Still more particularly, the present disclosure relates to manufacturing methods for mooring buoys made of particular materials.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Single point mooring systems have frequently been used in offshore locations for the loading and unloading of hydrocarbons or other flowable cargos into or out of marine vessels such as tankers, Floating Production Storage and Offloading (FPSO) systems, barges and the like. Offshore wind collection systems also utilize mooring systems to secure them to the seabed. These mooring systems commonly use buoys to support mooring lines and hold particular portions of the mooring lines above the sea floor and closer to the surface. In many cases, these buoys may be made from steel materials and able to be used in deep water and arctic environments to withstand the harsh conditions. The steel buoys may have a smooth surface for open sea and/or deep-water deployment to withstand the external pressure of a submerged device. Internal stiffener rings are used to help to withstand the external pressure. The stiffener rings are welded to the inside of the buoys.

SUMMARY

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments. Examples involve a mooring buoy comprising a cylindrical structural shell. The cylindrical structural shell comprises fiberglass reinforced plastic (FRP) and has a first open end and an opposite second open end. A plurality of annular stiffeners are bonded to an inside of the cylindrical structural shell. A first endcap is disposed on the first open end of the cylindrical structural shell. The first endcap is configured to substantially cover the first open end. A second endcap is disposed on the second open end of the cylindrical structural shell. The second endcap is configured to substantially cover the second open end. At least one cylindrical attachment mechanism is coupled to an outside of the cylindrical structural shell. The cylindrical attachment mechanism is configured to attach mooring lines to the cylindrical structural shell.

A method of manufacturing a fiberglass reinforced plastic (FRP) mooring buoy comprises placing a plurality of removable annular spacers and at least one stationary annular stiffener on a mandrel. Each pair of removable annular spacers of the plurality of removable annular spacers are configured to have one of the at least one stationary annular stiffener disposed therebetween. An endcap is placed on first end of the mandrel. The endcap is disposed proximate one of the removable annular spacers. A hollow cylindrical structural shell is formed on at least the plurality of stationary annular stiffeners. The mandrel is removed from the at least one stationary annular stiffener and the plurality of removable annular spacers leaving an open end and an opposing end closed by the endcap. At least one removable annular spacer of the plurality of removable annular spacers is collapsed. The plurality of removable annular spacers are removed from the cylindrical structural shell.

An example moorage system, comprises a buoy configured to be attached to one or more of a boat and an offshore floating wind tower. A mooring buoy is coupled to the buoy, the mooring buoy comprising. The mooring buoy comprises a cylindrical structural shell comprising fiberglass reinforced plastic (FRP). The cylindrical structural shell has a first open end and an opposite second open end. A plurality of annular stiffeners are bonded to an inside of the cylindrical structural shell. A first endcap is disposed on the first open end of the cylindrical structural shell. The first endcap is configured to substantially cover the first open end. A second endcap is disposed on the second open end of the cylindrical structural shell. The second endcap is configured to substantially cover the second open end. At least one cylindrical attachment mechanism is coupled to an outside of the cylindrical structural shell. The cylindrical attachment mechanism is configured to attach mooring lines to the cylindrical structural shell. At least one mooring line configured to attach the mooring buoy to the buoy and to a sea floor.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Offshore floating wind tower or other floating systems may be secured to the seabed using a mooring system. These mooring systems utilize buoys like those described herein. Steel buoys may be subject to corrosion and steel materials resistant to corrosion can be expensive and/or cost prohibitive. Examples described herein use materials not subject to corrosion. For example, buoys described herein may comprise Fiberglass Reinforced Plastic (FRP). The stiffener rings for the FRP buoys may be bonded to the shell instead of welded allowing for a significant reduction in manufacturing time by avoiding manual or automated welding. According to various configurations, the stiffener rings are laminated to the inside of the body of the mooring buoy. In some cases, the stiffener rings are integrated into the buoy during manufacture of the shell.

Figure 1:
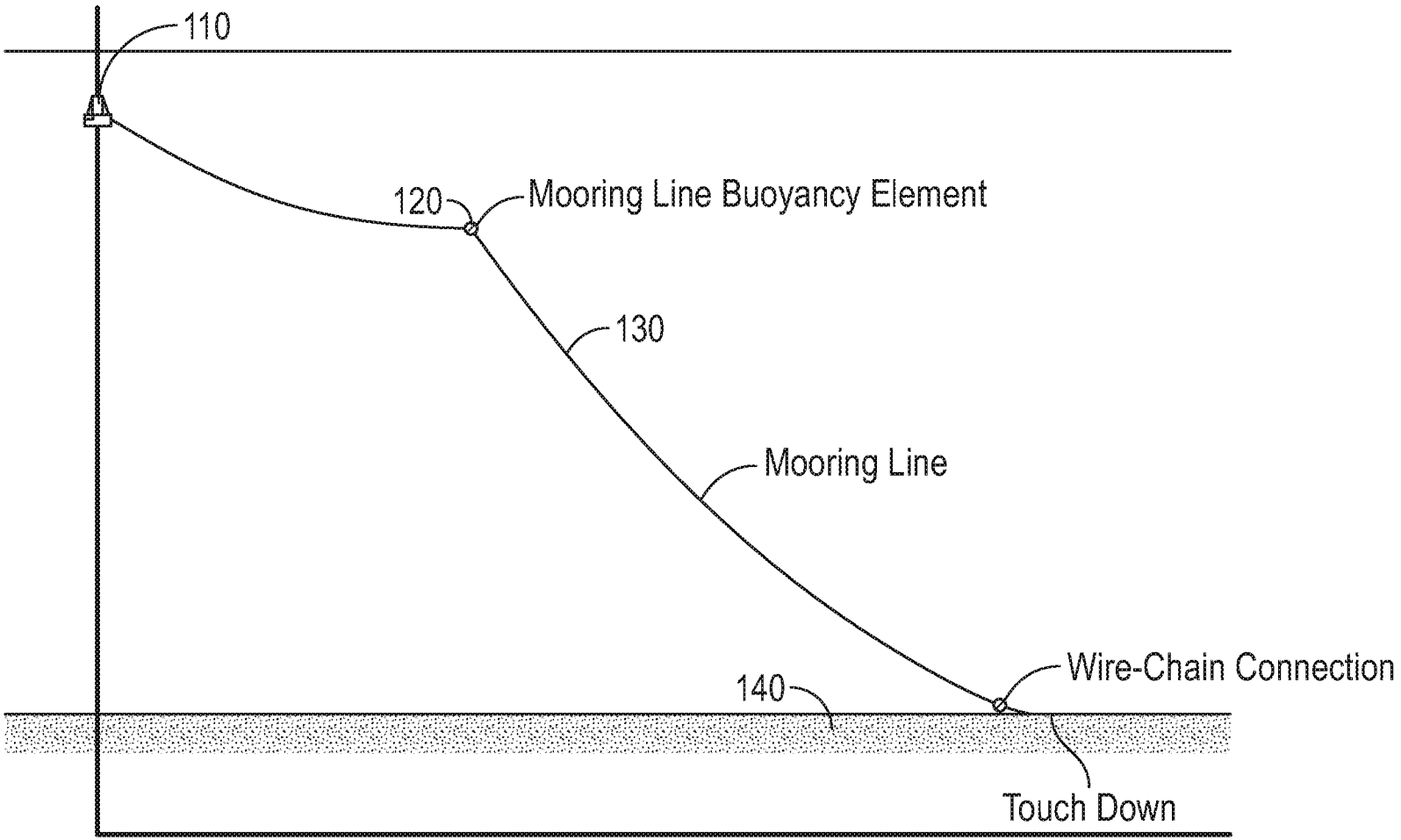
FIG. 1 illustrates a system for mooring of a power collection device according to one or more examples.

FIG. 1 illustrates a system for mooring of a power collection device or other floating object or system. According to various configurations, FIG. 1 shows a system for mooring an offshore floating wind tower, FPSO, or other floating system or object. The floating power collection device may be collected to main buoy 110. The main buoy 110 may be configured to be coupled with the floating power collection device at or near the water surface. The main buoy 110 is coupled to a buoyancy element 120 via a mooring line 130. The mooring line is secured to the seabed 140 by the mooring line 130. The mooring line buoyancy element 120 may be a tank or other hollow element having a substantially smooth exterior with at least one mooring line attachment mechanism.

Figure 2A:
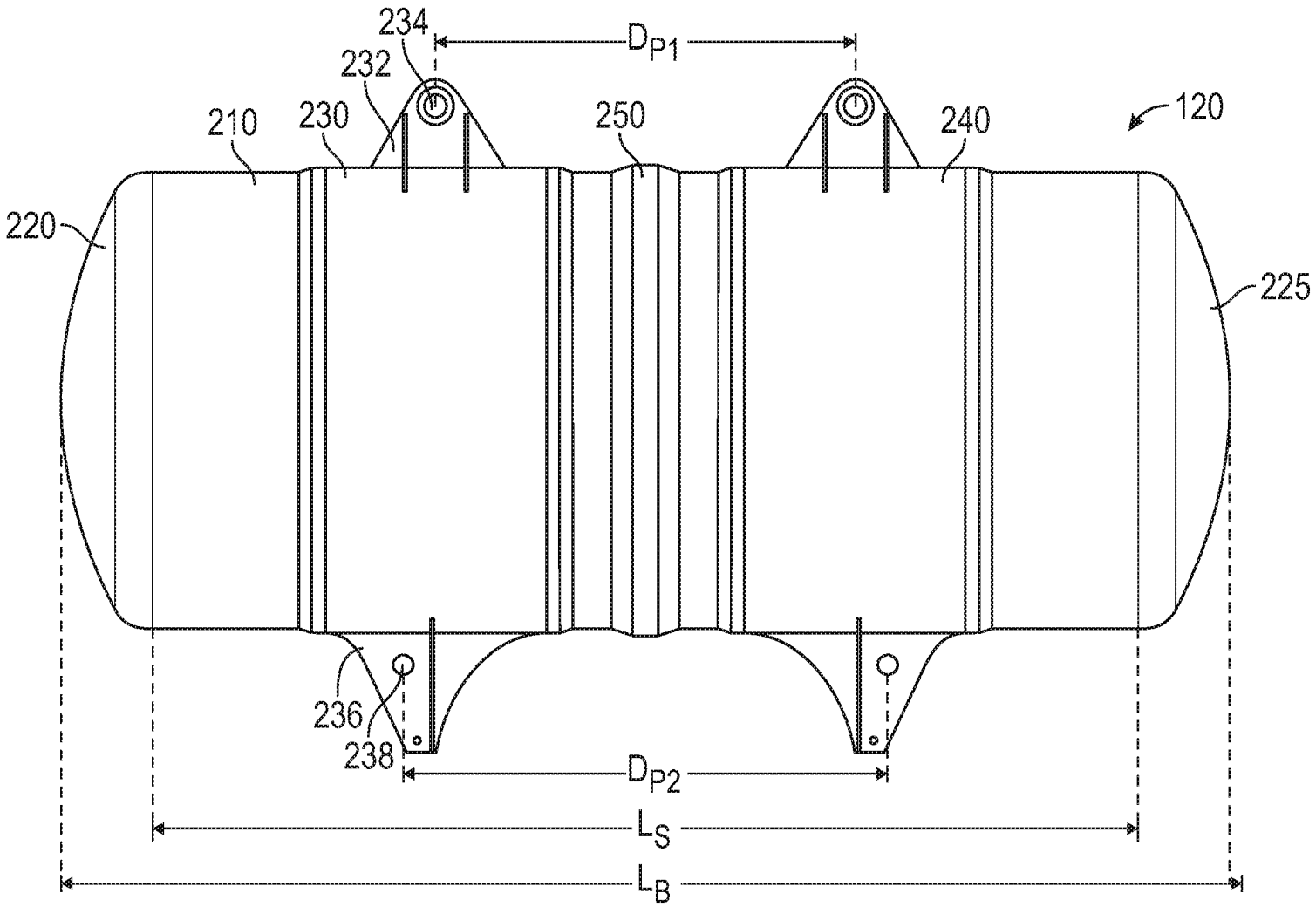
FIGS. 2A and 2B illustrate two different views of an example buoyancy element according to one or more examples.
Figure 2B:
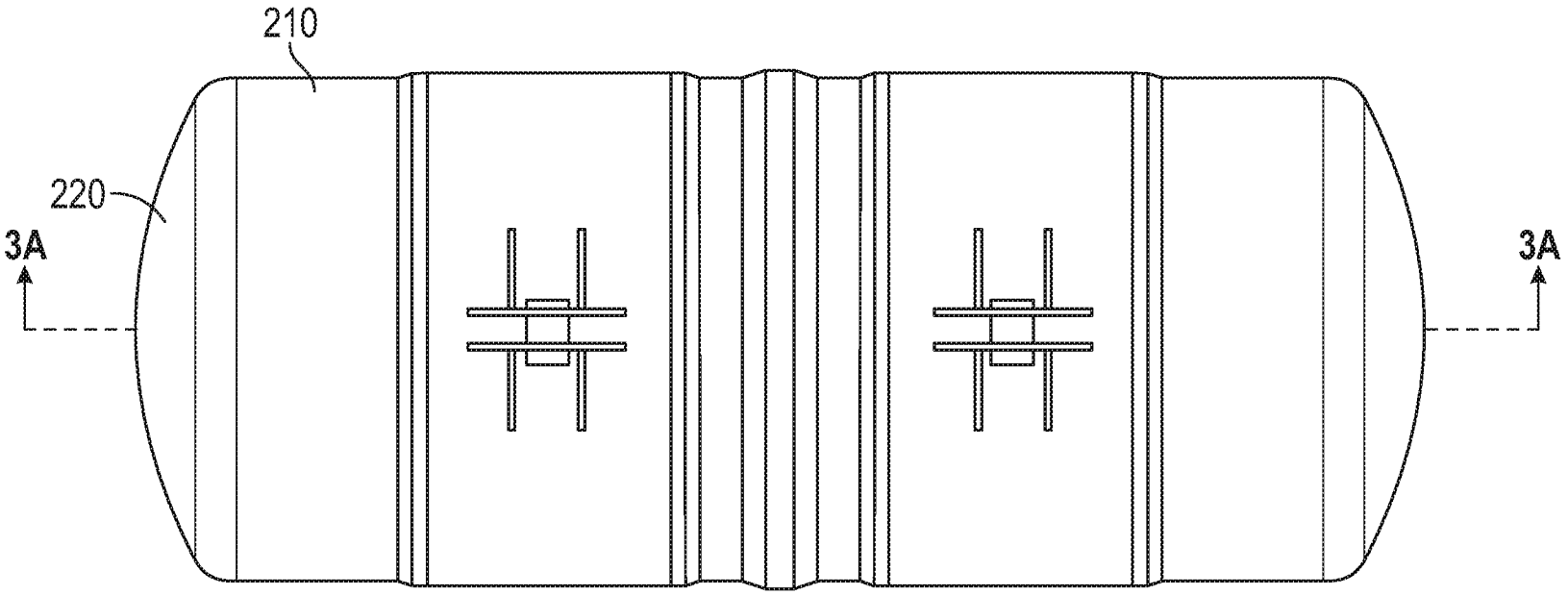

FIGS. 2A and 2B illustrate two different views of an example buoyancy element 120 in accordance with examples described herein. As suggested, the buoyance element may be configured to withstand forces associated with being submerged as well as the lateral and/or tensile forces exerted on the buoy from the supported mooring lines. According to various configurations, the buoyancy element includes a shell 210 that may be formed in two parts and joined along a seam 250. A first endcap 220 may be coupled to a first end of the cylindrical structural shell 210 and a second endcap 225 may be coupled to a second opposing end of the cylindrical structural shell 210. As shown, the buoyancy element may have a length, $L_B$, in a range of about 10 feet to about 40 feet or in a range of about 20 feet to about 30 feet. The cylindrical structural shell 210 may have an outer diameter in a range of about 6 feet to about 16 feet. In some cases, the cylindrical structural shell has an outer diameter in a range of about 8 feet to about 14 feet. For example, the cylindrical structural shell may have a diameter of about 8, 10, 12, or 14 feet.

In this example, a cylindrical structural shell 210 has a metal band, a first attachment mechanism 230 and a second attachment mechanism 240 secured thereto. Each attachment mechanism 230, 240 may include a reinforcing ribbon or band that extends around the peripheral surface of the shell 210 and has protrusions that extend out from the attachment mechanism. For example, the first attachment mechanism 230 may have a first protrusion 232 with a first hole 234 and a second protrusion 236 having a second hole 238.

According to various examples, the first protrusion 232 is configured to be a lifting lug for transporting and/or positioning the buoy, for example. For example, the first protrusion 232 may be configured for substantially vertical load lifting. The second protrusion 236 may be configured to attach to one or more mooring lines and/or allow for travel along the mooring line.

The distance, $D_{P1}$, between the first holes disposed on the first attachment mechanisms is in a range of about 5 feet to about 15 feet or in a range of about 8 feet to about 10 feet. The distance, $D_{P2}$, between the second holes disposed on the second attachment mechanisms is in a range of about 5 feet to about 15 feet or in a range of about 8 feet to about 12 feet. One or both of the first hole and the second hole may be configured to accept a mooring line for securing the buoy to the power collection device or other floating element and/or the seabed.

Figure 3A:
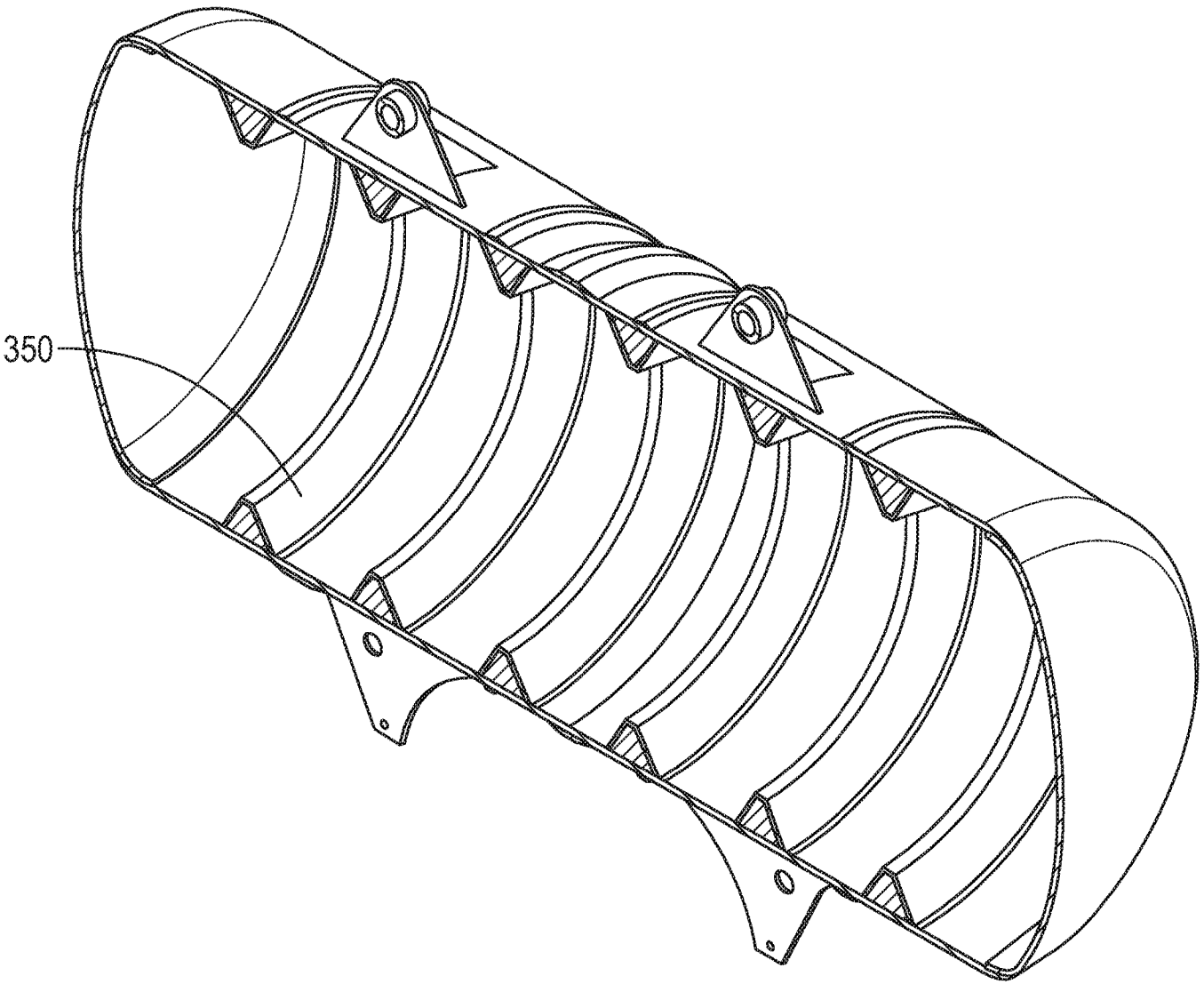
FIGS. 3A and 3B show two different views of a cross section of the buoyancy element according to one or more examples.
Figure 3B:
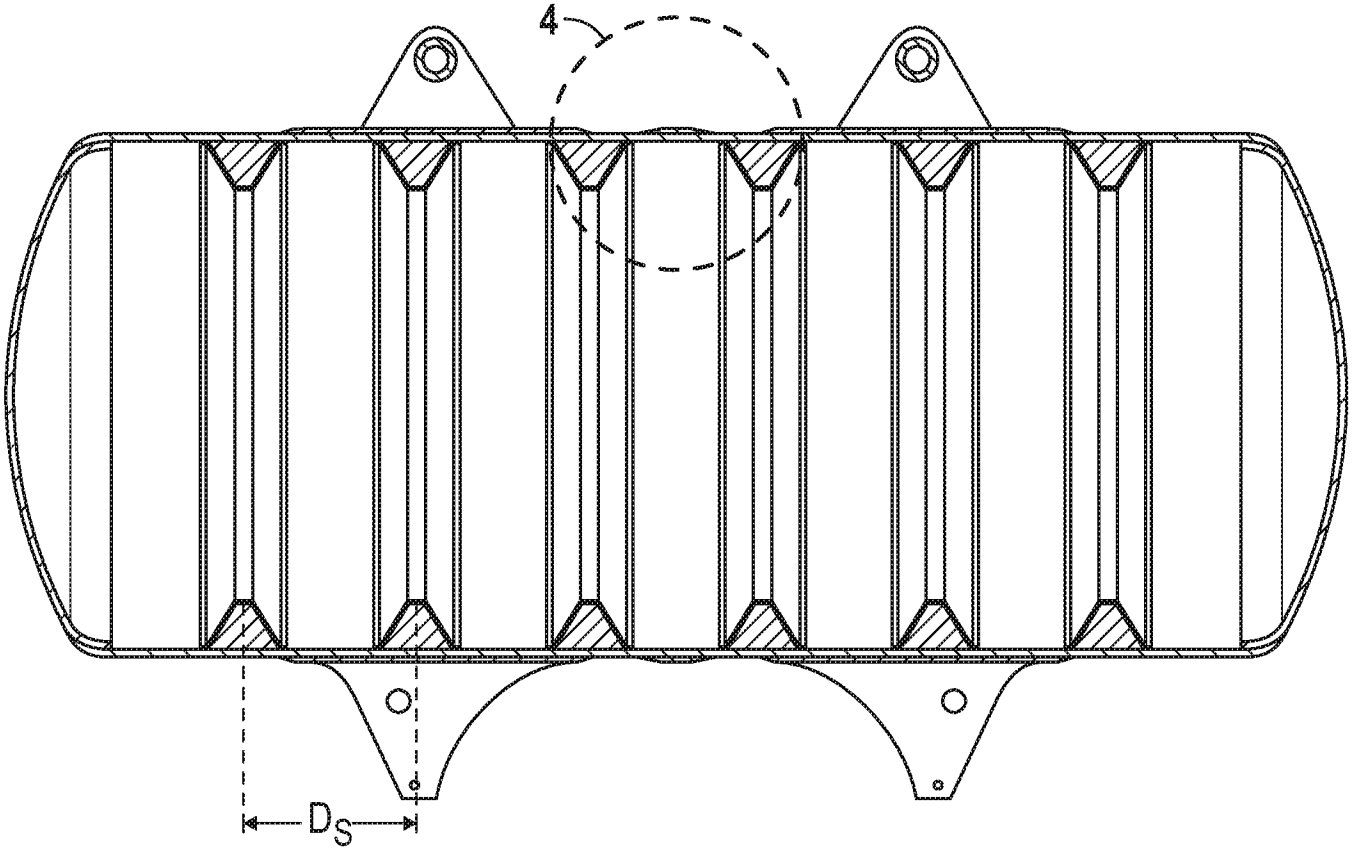

FIGS. 3A and 3B show two different views of a cross section of the buoyancy element in accordance with examples described herein. As shown, a plurality of stiffening rings 350 may be disposed along the periphery of the inside of the cylindrical structural shell. According to various examples, the stiffening rings 350 are disposed along an interior length of the cylindrical structural shell. The density (e.g., number of rings per unit of distance along the shell) of stiffening rings along the length may differ based on a desired application for the buoy.

The stiffening rings may be generally annularly shaped elements. In some cases, the stiffening rings may have a generally triangular cross-section with a base and a decreasing linear taper as they protrude toward the center of the structural shell and to an apex of the triangular cross-section. While a triangular cross-section has been described, a rectangular, square, or other cross-section may also be provided. In one or more examples, the stiffening rings may be spaced along the length of the shell 210 by a distance, $D_S$, between adjacent stiffening rings. In one or more examples, the distance $D_S$ may be substantially identical for all of the stiffening rings. For example, $D_S$ may be in a range of about 2 feet to about 6 feet or in a range of about 3 feet to about 4 feet. In some cases, the distance between adjacent stiffening rings may vary along the length of the buoy. For example, in some cases, a tighter spacing of stiffening rings may be provided at or near the attachment mechanisms where loading of the shell may be less uniform.

In some cases, the stiffening rings may not extend along the entire periphery of the structural shell. Also, while FIGS. 3A and 3B show a width of the stiffening rings at the structural shell to be substantially uniform, it is to be understood that one or more of the stiffening rings may have a width that is different than at least one other stiffening ring.

Figure 4:
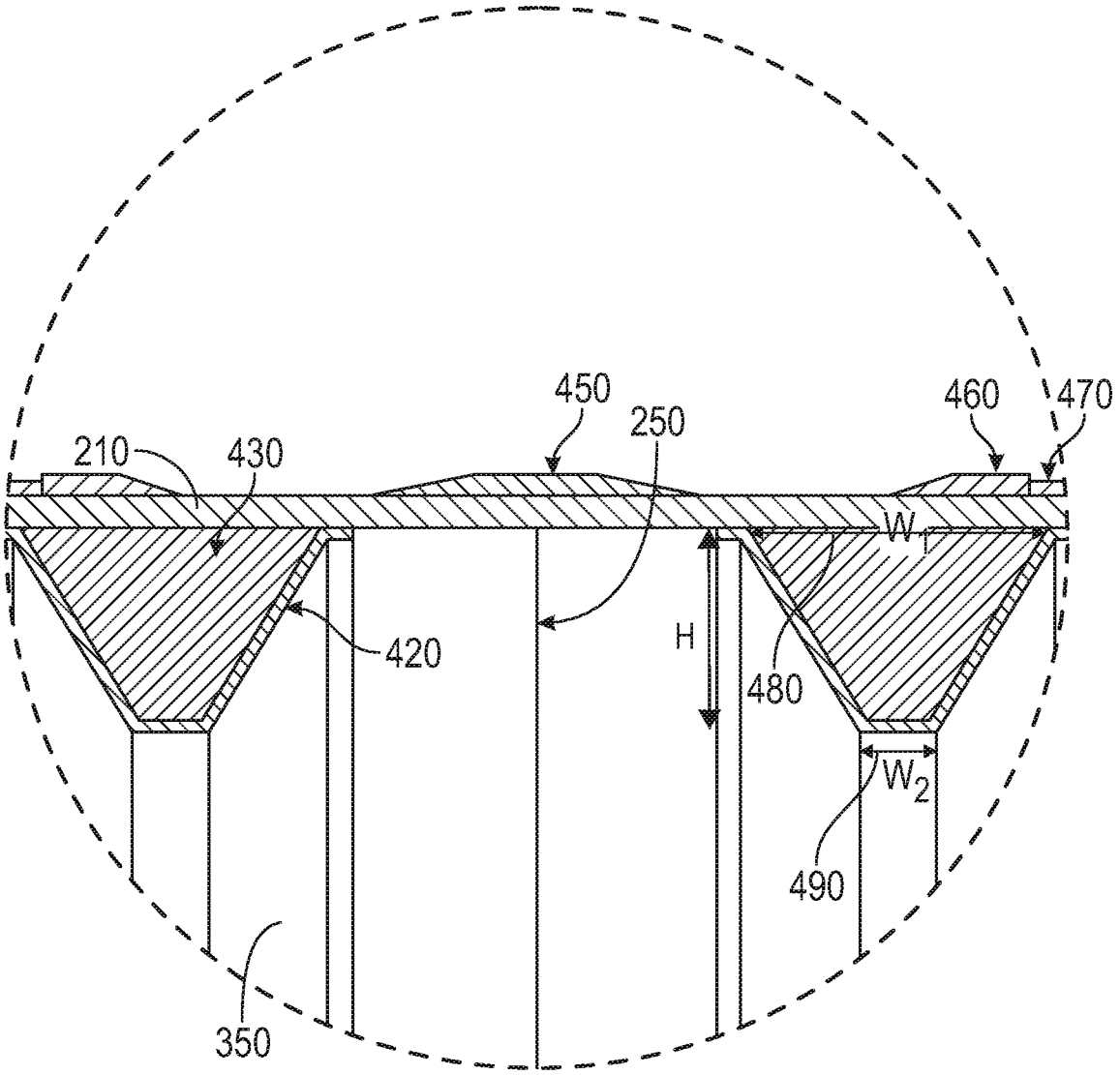
FIG. 4 illustrates a more detailed view of stiffeners coupled to the inside of the buoyancy element according to one or more examples.
Figure 5:
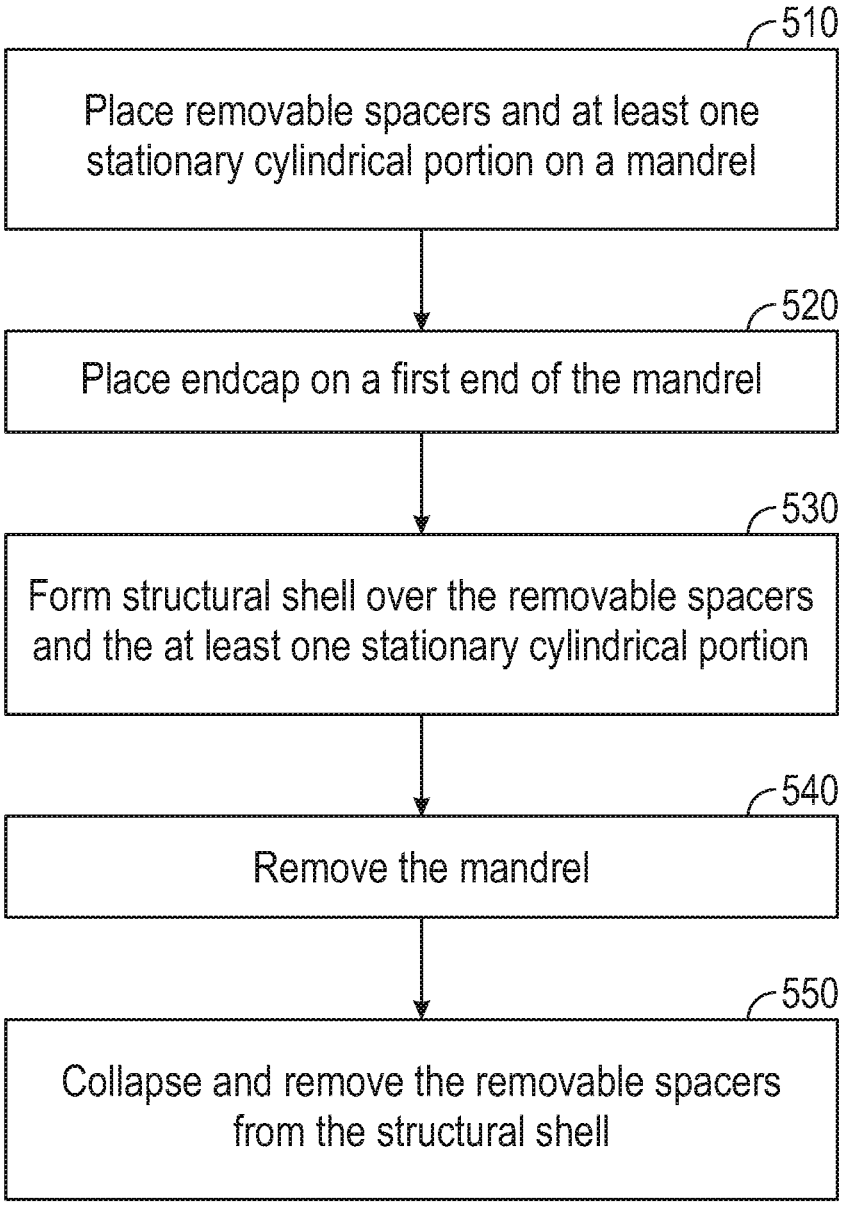
FIG. 5 illustrates a process for forming a Fiberglass Reinforced Plastic (FRP) buoyancy element according to one or more examples.

FIG. 4 illustrates a more detailed view of the inside of the buoyancy element and, in particular, the details of the stiffening rings 350 and the seam 250, in accordance with examples described herein. The structural shell 210 comprises FRP, polyester, and/or epoxy resin as the matrix and glass fibers As mentioned, the structural shell 210 can include one or more stiffening rings 350 disposed along the inside of the structural shell 210. The stiffening rings 350 may include a stiffener rib 420 that defines a cross-sectional shape of the stiffening ring 350. That is, for example, the rib 420 may include a relatively thin and generally flat or plate-like material that is bent to form a pyramidal or triangular shape as shown or the rib may define a rectangular, square, or other cross-sectional profile. The stiffener rib 420 may include the same material as that of the structural shell. For example, the stiffener ribs 420 may comprise FRP. In some cases, the stiffener rib 420 comprises at least one material that is different than that of the structural shell 210. The stiffener rib 420 may define an internal volume 430 that is disposed between the stiffener rib 420 and the structural shell 210. The internal volume 430 may be at least partially filled with a different material than that of the stiffener ribs 420. For example, the internal volume may be filled with foam such as urethane. The stiffeners may be preformed before bonding them to the structural shell 210. For example, the stiffener ribs may be foam filled prior to bonding the stiffeners to the structural shell 210. In other examples, the stiffener ribs may be filled after bonding them to the shell through fill openings, for example.

Each stiffener has a first end 480 adjacent to an inside surface of the cylindrical structural shell and an opposing end 490 away from the inside of the cylindrical structural shell. The first end 480 has a first width, $W_1$, and the second end has a second width, $W_2$. According to various configurations, W1 is different than W2. In the example shown in FIG. 4, The stiffeners have a decreasing linear taper in a direction toward a center of the structural shell 210 and $W_2$ is less than $W_1$. In an example, $W_1$ can be in a range of about 8 inches to about 16 inches. $W_2$ may be in a range of about 4 inches to about 10 inches. A height, H, of the stiffeners may be in a range of about 4 inches to about 12 inches.

FIG. 4 further shows a seam 250 and a seam joint 450 at the location that the first side of the structural shell is joined to a second side of the structural shell 210. The seam joint 450 may include the same material as the structural shell 210. For example, the seam joint may comprise FRP and joining the first and second sides of the structural shell 210 may include holding the first and second sides adjacent one another and laying up FRP on the seam to join the first and second sides. In some cases, the seam joint 450 comprises a different material than that of the structural shell.

A metal band 470 is configured to be coupled to the first protrusion 232 and the second protrusion 236. According to various examples, the metal band 270 is continuous around the structural shell 232. In some cases, the metal band 270 is not continuous around the structural shell 210. For example, the metal band may be a bolted clamshell to facilitate installation and/or removal. An FRP bumper stop 460 is configured to fix the metal band 270 at a particular location along the structural shell 210.

Figure 6:
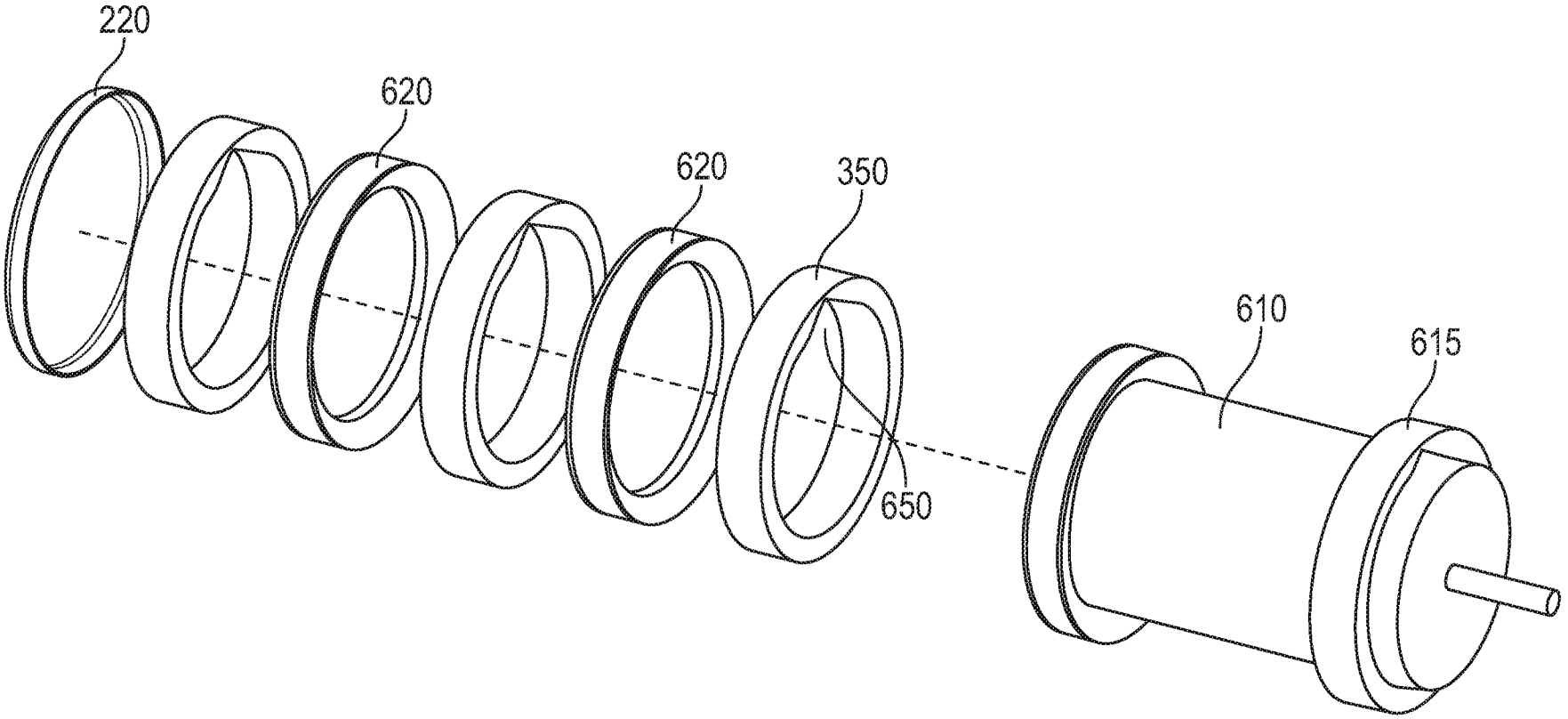
FIG. 6 illustrates placing stiffeners, spacers, and an endcap on a mandrel according to one or more examples.
Figure 7:
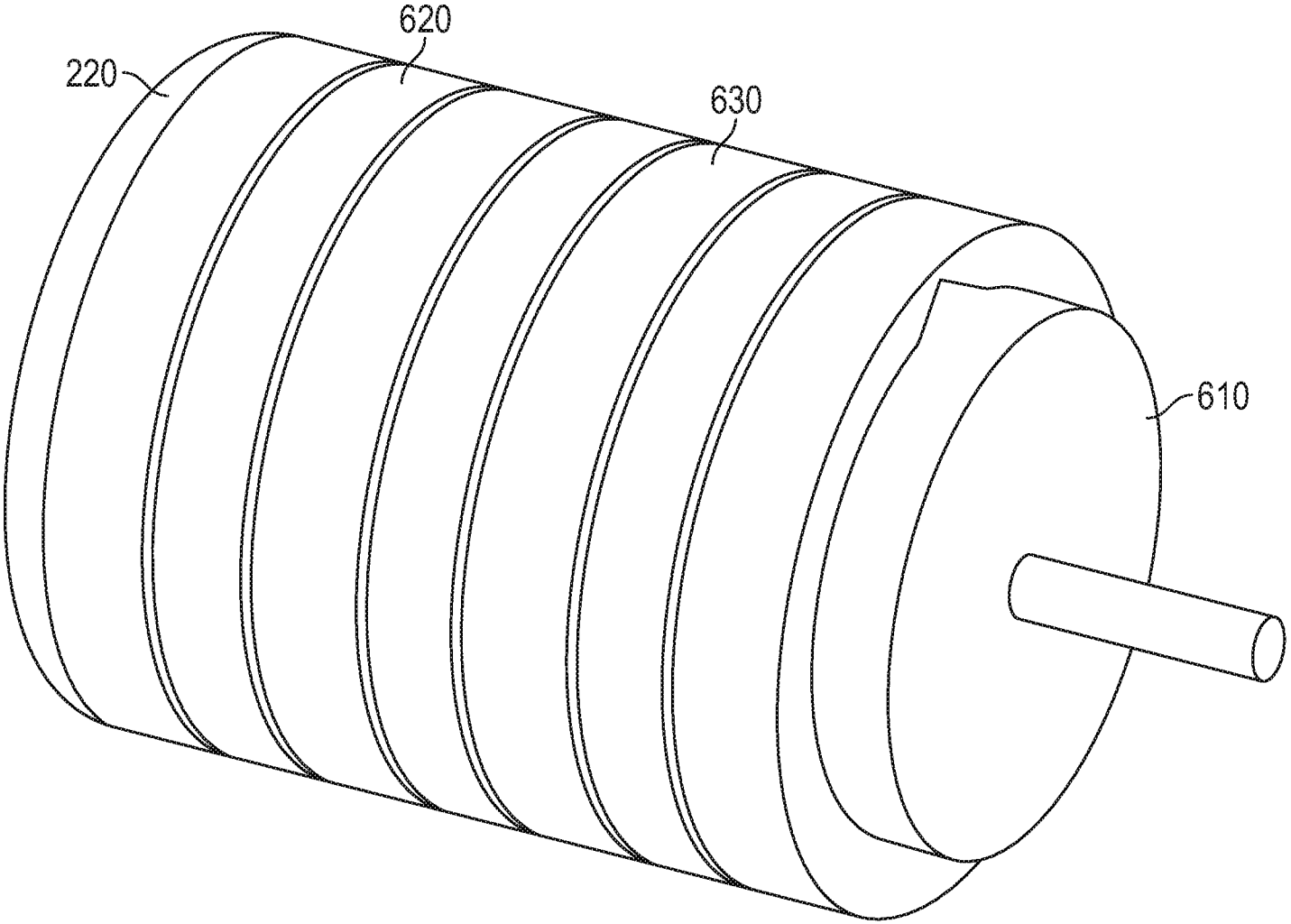
FIG. 7 shows the stiffeners, spacers, and endcap placed on the mandrel according to one or more examples.
Figure 8:
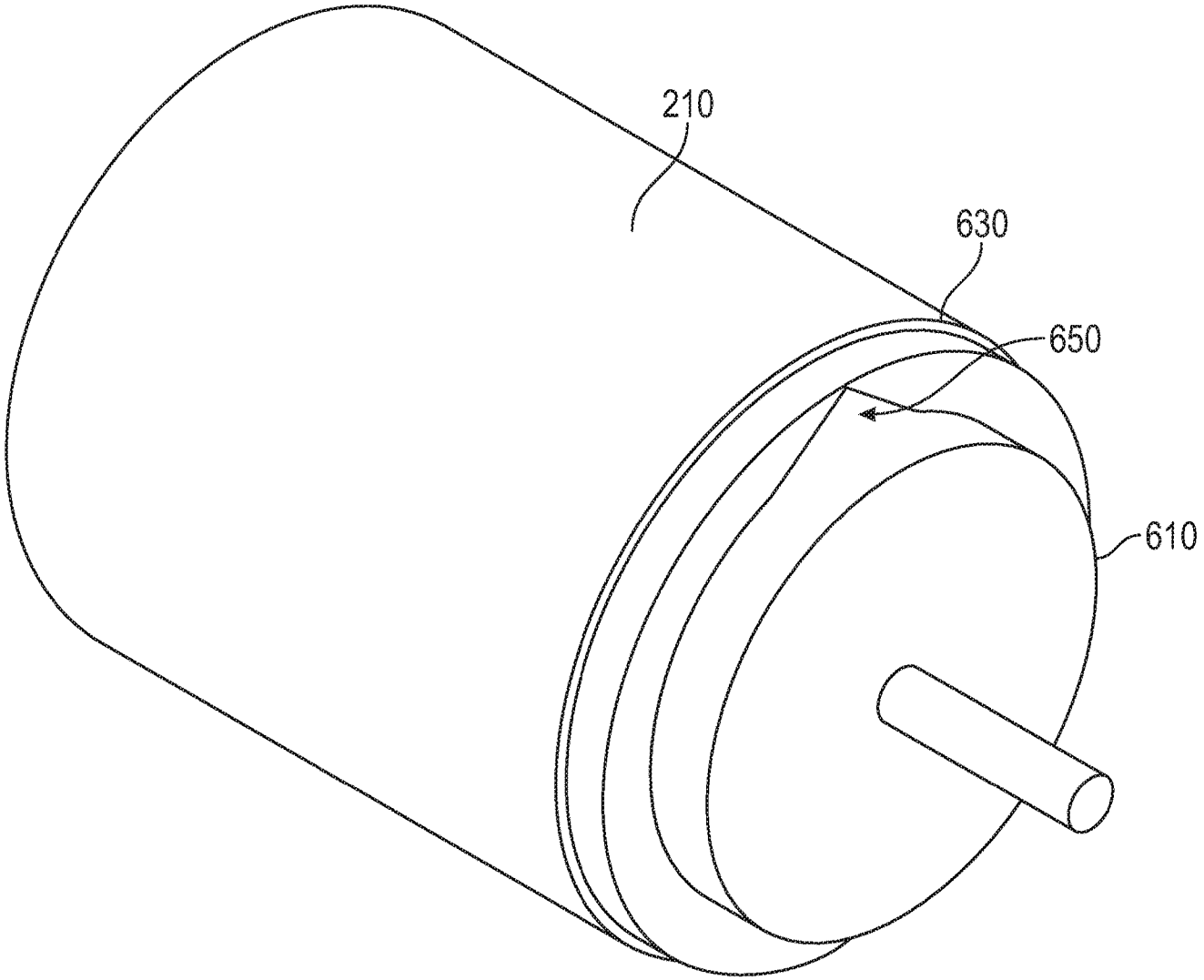
FIG. 8 shows a cylindrical structural shell formed over the stiffeners and spacers according to one or more examples.

FIGS. 5-14 illustrate a process for forming a buoyancy element in accordance with examples described herein. In particular, FIG. 5 outlines one or more method steps involved in the process and FIGS. 6-14 include diagrams showing one or more stages of the process. For example, and as shown in FIG. 6, at least one stiffening ring 350 and a plurality of removable annular spacers 630 are placed 510 on a mandrel 610. According to various configurations, each pair of removable annular spacers are configured to have one of the at least one stiffening ring 350 disposed therebetween. For example, the stiffening rings 350 and the annular cylindrical spacers 630 may be arranged in juxtaposed alternating fashion on the mandrel 610. In the example shown in FIG. 6, there are four removable annular cylindrical spacers 630 and three stiffening rings 350. It is to be understood that more or fewer removable spacers and/or stationary stiffening rings may be used. An endcap 220 is placed on at least one end of the mandrel. According to various configurations, the endcap is placed 520 proximate a removable spacer 630, but may, alternatively be placed proximate a stiffening ring 350. In some cases, the endcap has a substantially convex shape when viewed from the outside. FIG. 7 illustrates the stiffening rings 350, the removable spacers 630, and the endcap 220 placed on the mandrel 610.

According to various configurations, at least some of the removable spacers 630 have one or more notches 650 that allow them to collapse to be removed from in between the stiffening rings after the shell is formed and the mandrel is removed.

A cylindrical structural shell 210 is formed over the alternating stiffening rings 620 and removable spacers 630. The structural shell 210 is formed and bonded 530 to at least the stiffening rings 620 using a filament winding process, for example. The cylindrical structural shell 210 may be configured to substantially cover one or both of the removable spacers 630 placed on either end of the mandrel.

According to various configurations, an attachment mechanism 910 is coupled to the outside of the cylindrical structural shell. The attachment mechanism 910 may comprise metal. For example, the attachment mechanism 910 may comprise steel. The attachment mechanism has a first protrusion 920 on a first side and a second protrusion 930 on an opposing second side of the attachment mechanism 910. The first protrusion 920 may be a lift lug, for example. The second protrusion 930 may be a cable lug.

Figure 9:
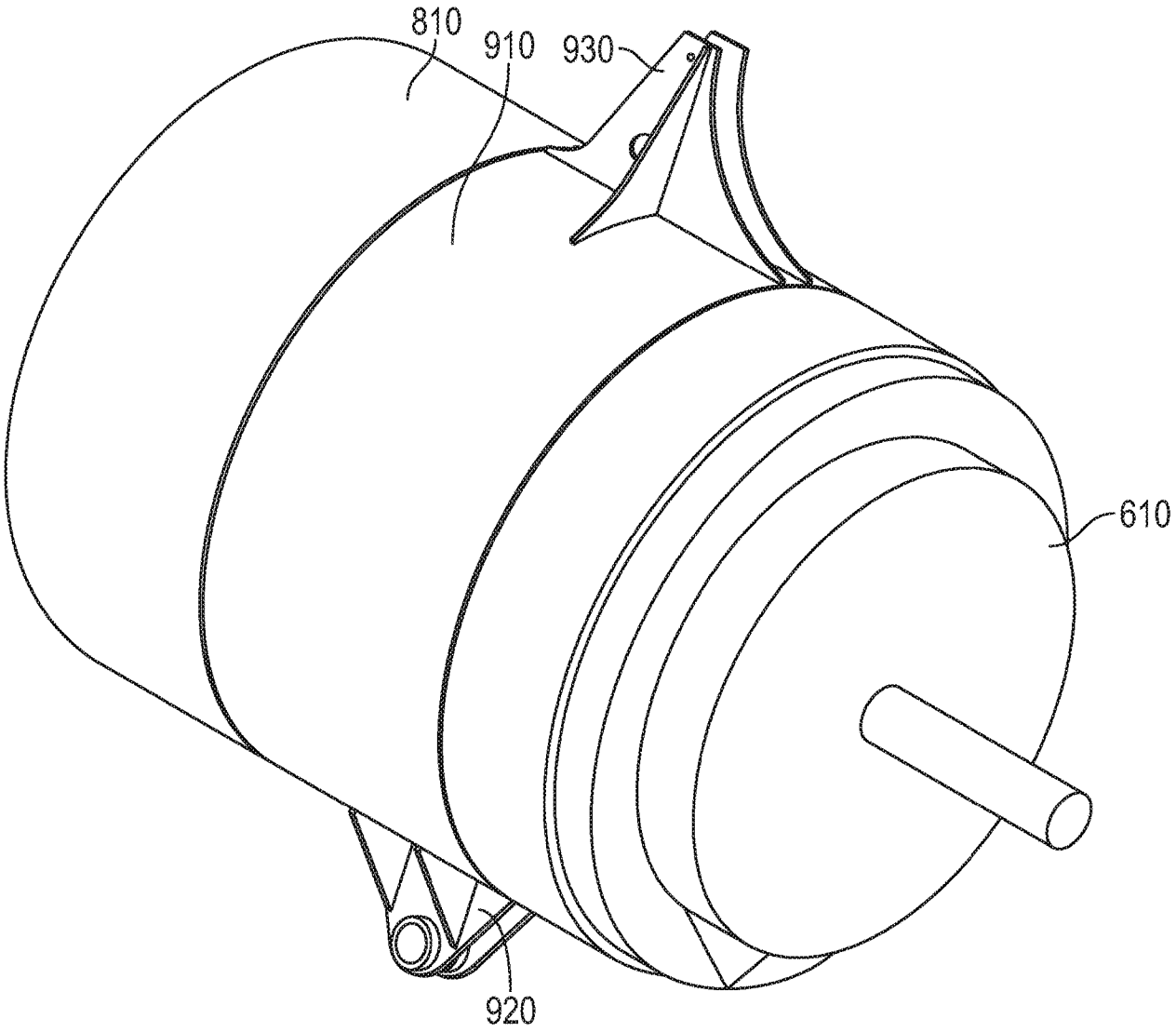
FIG. 9 illustrates an attachment mechanism bonded to the cylindrical structural shell according to one or more examples.

While the example shown in FIG. 9 illustrates the first protrusion 920 and the second protrusion to be substantially opposite each other along the circumference of the attachment mechanism 910, it is to be understood that the first protrusion 920 and the second protrusion 930 may be located anywhere along the periphery of the attachment mechanism 910. More or fewer protrusions may be disposed on the attachment mechanism 910 in some examples. One or both of the first protrusion 920 and the second protrusion 930 has a hole configured to accommodate a mooring line.

Figure 10:
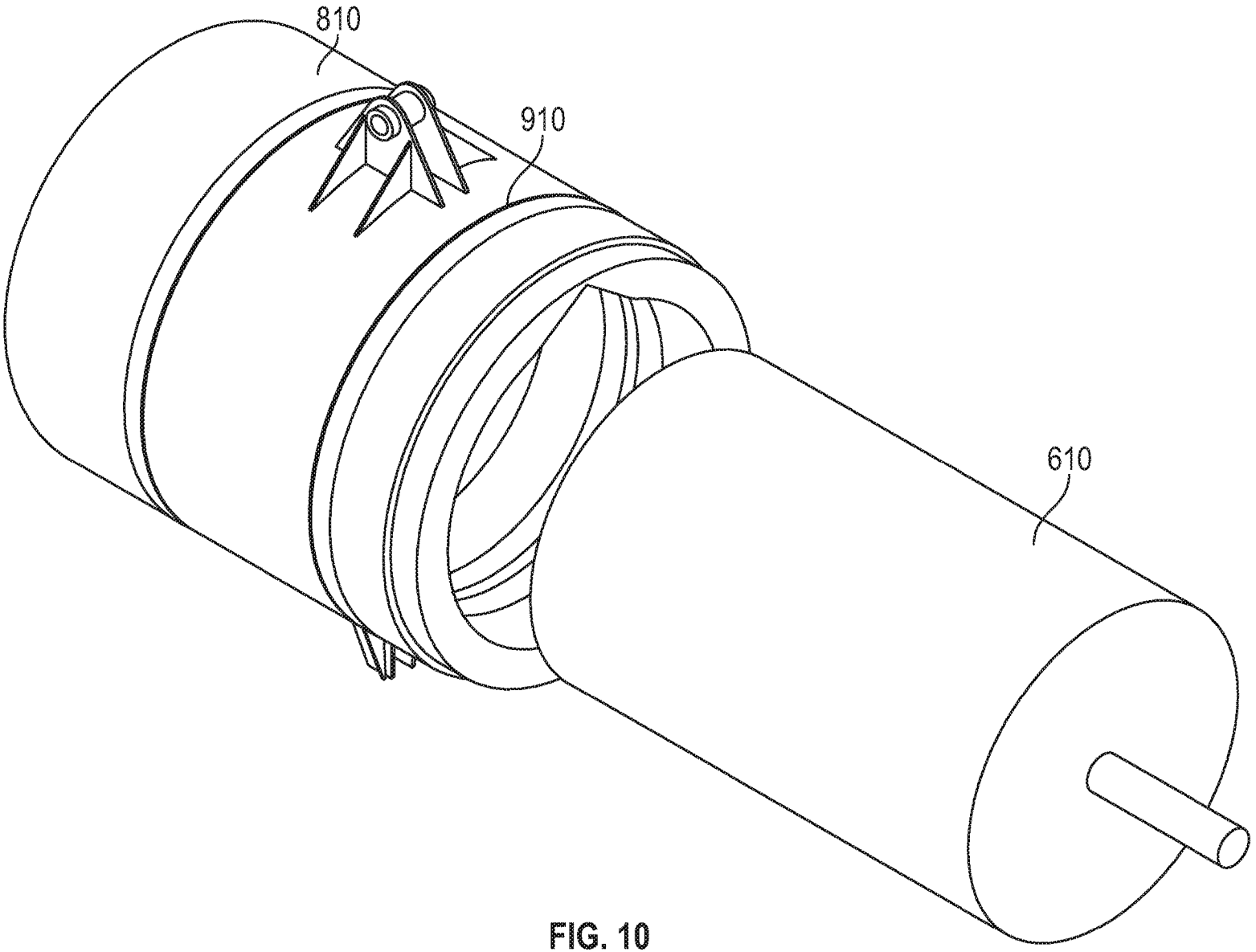
FIG. 10 shows the mandrel being removed from the stiffeners and the spacers according to one or more embodiments.
Figure 11:
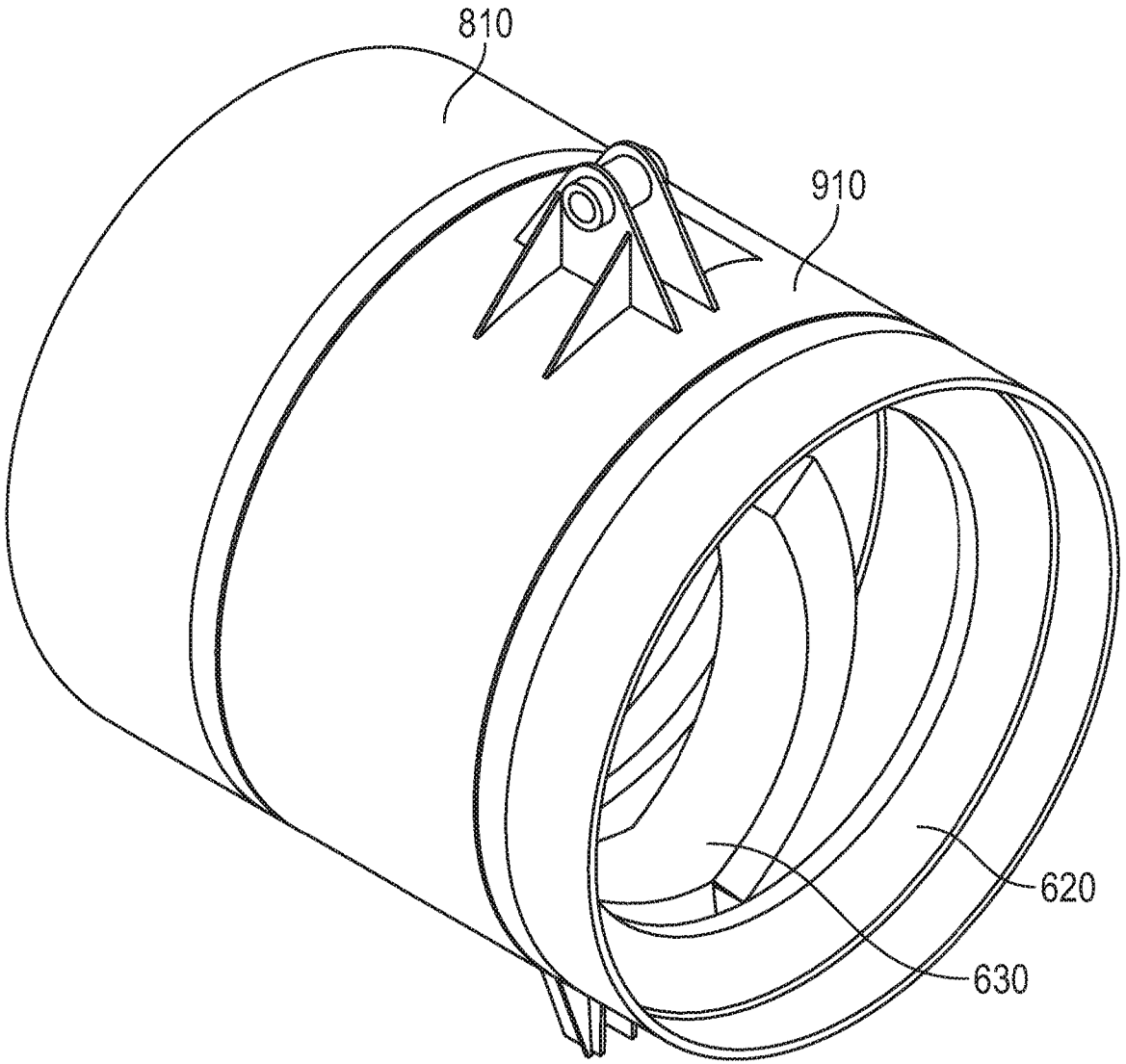
FIG. 11 illustrates collapsing the spacers from so that they can be removed according to one or more examples.
Figure 12:
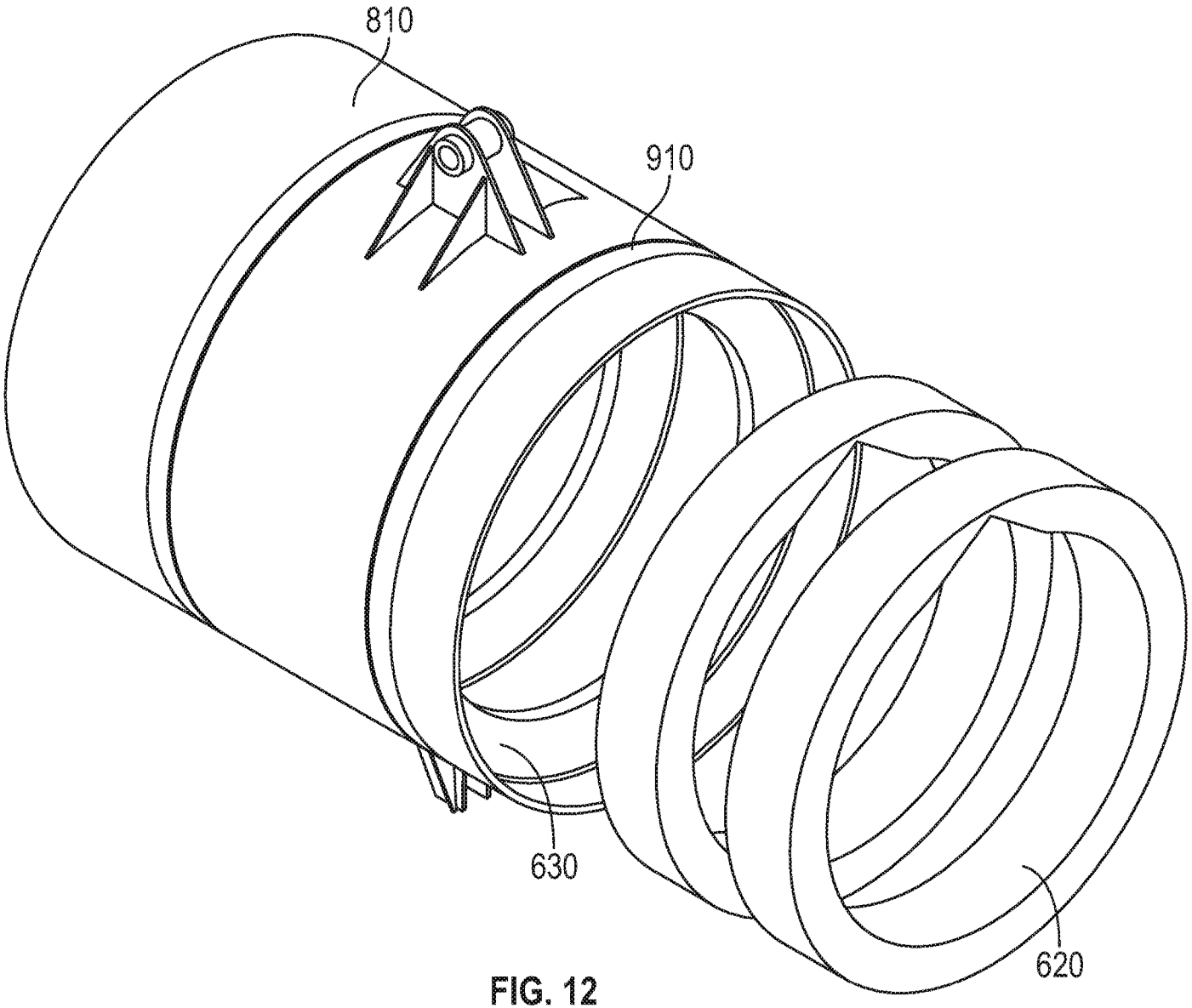
FIG. 12 shows removing the spacers from in between the stiffeners according to one or more examples.

The mandrel 610 is removed 540 from the stiffening rings 620 and the removable spacers 630 leaving an open end and an opposing end closed by the endcap as shown by FIG. 10. After the mandrel 610 is removed, the removable spacers 630 are collapsed and removed 550 as shown in FIGS. 11 and 12. The removable spacer 615 disposed on the open end of the device may be removed without being collapsed. Any additional removable spacers 630 are configured to collapse so that they can be removed from in between the stiffening rings 620. That is, as mentioned above, at least one notch 650 may be provided in the removable spacers 630. According to various examples, the notch 650 allows one end of an annular spacer to slide radially inward relative to an opposing end. A plurality of control joints may be disposed at locations along an outer periphery of the spacers. The control joints may be configured to cause the spacer to bend and/or break at those locations allowing the spacer to be removed. According to various configurations, the removable spacers 630 may be configured to break apart in at least three places.

Figure 13:
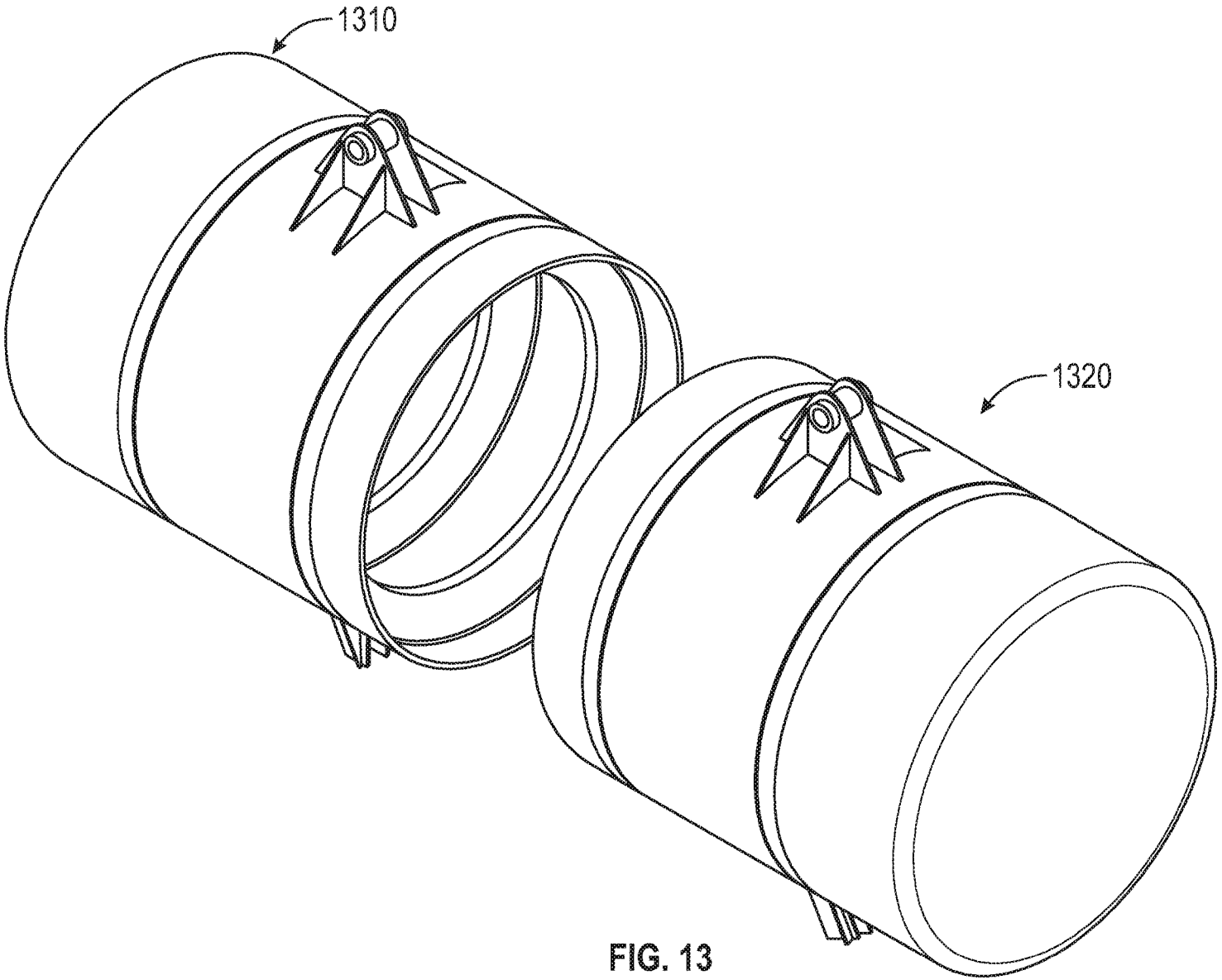
FIG. 13 illustrates two portions of a mooring buoy being joined together at their respective open ends according to one or more examples.
Figure 14:
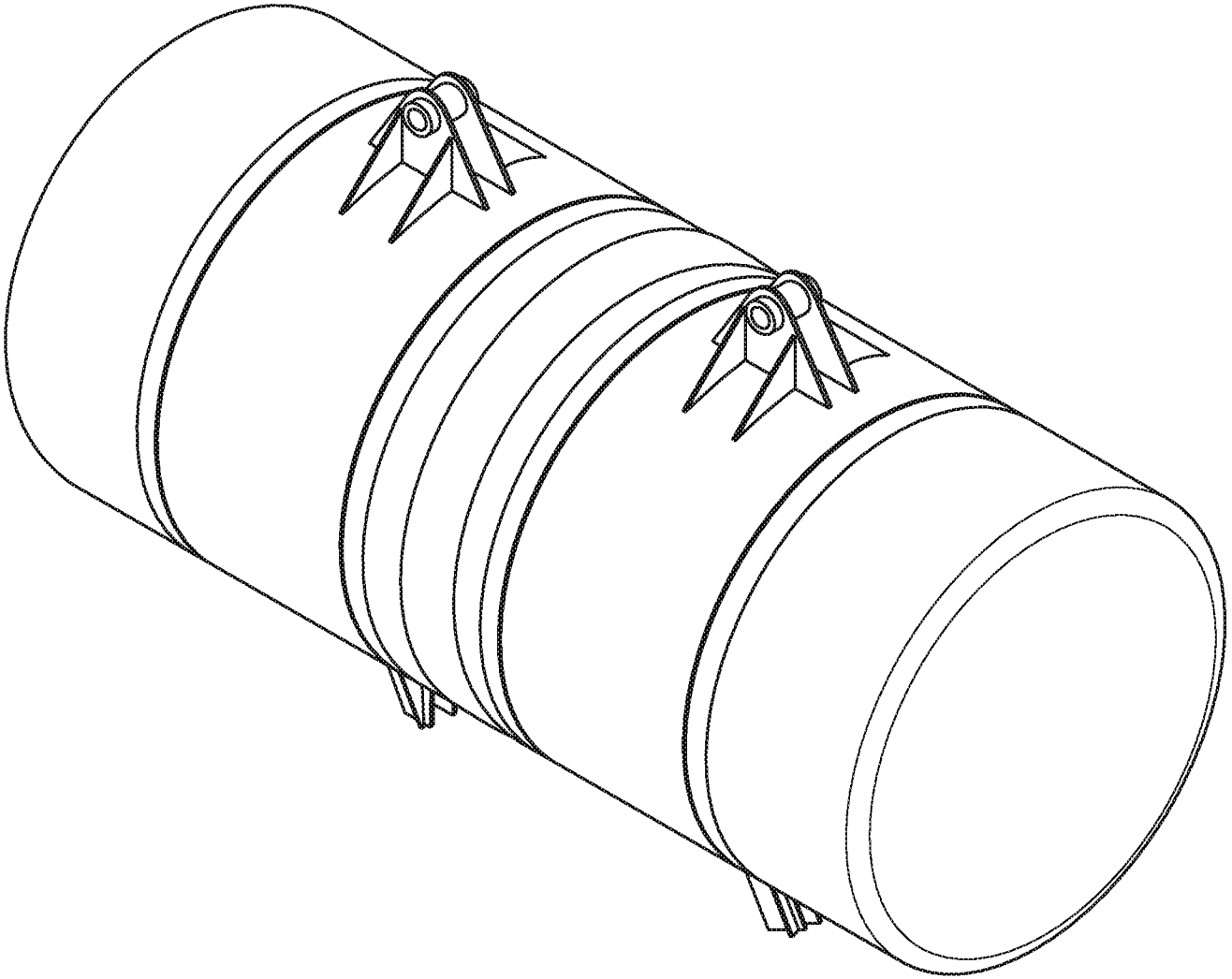
FIG. 14 shows the mooring buoy after the two portions have been joined together at their respective open ends according to one or more examples.

In some configurations, a first buoy structure 1310 and a second buoy structure 1320 are formed and the open ends of the respective buoy structures are bonded together to create the mooring buoy as shown in FIGS. 13 and 14. In some examples, after the removable spacers 630 have been removed from the buoy structure, a second endcap may be bonded on the open end.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A mooring buoy, comprising:

a cylindrical structural shell comprising fiberglass reinforced plastic (FRP), the cylindrical structural shell having a first open end and an opposite second open end;

a plurality of annular stiffeners bonded to an inside of the cylindrical structural shell;

a first endcap disposed on the first open end of the cylindrical structural shell, the first endcap configured to substantially cover the first open end;

a second endcap disposed on the second open end of the cylindrical structural shell, the second endcap configured to substantially cover the second open end; and at least one cylindrical attachment mechanism coupled to an outside of the cylindrical structural shell, the cylindrical attachment mechanism configured to attach mooring lines to the cylindrical structural shell.

2. The mooring buoy of claim 1 wherein each annular stiffener tapers towards a center of the cylindrical structural shell.

3. The mooring buoy of claim 1, wherein each annular stiffener has a first end adjacent to an inside surface of the cylindrical structural shell and an opposing second end away from the inside of the cylindrical structural shell, the first end having a first width and the second end having a second width different than the first width.

4. The mooring buoy of claim 3, wherein the second width is less than the first width.

5. The mooring buoy of claim 1, wherein each annular stiffener comprises a stiffener rib and an internal volume between the stiffener rib and the cylindrical structural shell.

6. The mooring buoy of claim 5, wherein the stiffener ribs comprise FRP and at least a portion of the internal volume is filled with foam.

7. The mooring buoy of claim 1, wherein the cylindrical structural shell has an outer diameter of about 6 feet to about 12 feet.

8. The mooring buoy of claim 1, wherein the cylindrical shell has an outer diameter of about 8 feet to about 10 feet.

9. The mooring buoy of claim 1, wherein the mooring buoy is configured to be used in moorage systems for offshore floating wind towers.

10. A method of manufacturing a fiberglass reinforced plastic (FRP) mooring buoy, comprising:

placing a plurality of removable annular spacers and at least one stationary annular stiffener on a mandrel, each pair of removable annular spacers of the plurality of removable annular spacers configured to have one of the at least one stationary annular stiffener disposed there between;

placing an endcap on first end of the mandrel, the endcap disposed proximate one of the removable annular spacers;

forming a hollow cylindrical structural shell on at least the plurality of stationary annular stiffeners;

removing the mandrel from the at least one stationary annular stiffener and the plurality of removable annular spacers leaving an open end and an opposing end closed by the endcap;

collapsing at least one removable annular spacers of the plurality of removable annular spacers; and removing the plurality of removable annular spacers from the cylindrical structural shell.

11. The method of claim 10, wherein at least one of the removable annular cylindrical spacers is configured to break apart into at least three pieces.

12. The method of claim 10, wherein at least one of the removable annular cylindrical spacers comprises a notch.

13. The method of claim 12, wherein collapsing at least one removable annular spacer comprises:

sliding an end of the at least one removable annular spacer radially inward at the notch; and folding the spacer at a plurality of control joints disposed along a periphery of the at least one spacer.

14. The method of claim 11, further comprising attaching at least one cylindrical attachment mechanism to an outside of the cylindrical structural shell.

15. The method of claim 11, wherein forming the hollow cylindrical structural shell comprises forming the hollow cylindrical shell using a filament winding process.

16. A moorage system, comprising:

a buoy configured to be attached to one or more of a boat and an offshore floating wind tower;

a mooring buoy coupled to the buoy, the mooring buoy comprising:

a cylindrical structural shell comprising fiberglass reinforced plastic (FRP), the cylindrical structural shell having a first open end and an opposite second open end;

a plurality of annular stiffeners bonded to an inside of the cylindrical structural shell;

a first endcap disposed on the first open end of the cylindrical structural shell, the first endcap configured to substantially cover the first open end;

a second endcap disposed on the second open end of the cylindrical structural shell, the second endcap configured to substantially cover the second open end; and at least one cylindrical attachment mechanism coupled to an outside of the cylindrical structural shell, the cylindrical attachment mechanism configured to attach mooring lines to the cylindrical structural shell; and at least one mooring line configured to attach the mooring buoy to the buoy and to a sea floor.

17. The moorage system of claim 16, wherein each annular stiffener is configured to have a taper towards a center of the cylindrical structural shell.

18. The moorage system of claim 16, wherein each annular stiffener has a first end adjacent to an inside surface of the cylindrical structural shell and an opposing end away from the inside of the cylindrical structural shell, the first end having a first width and the second end having a second width different than the first width.

19. The moorage system of claim 18, wherein the second width is less than the first width.

20. The moorage system of claim 16, wherein each annular stiffener comprises a stiffener rib and an internal volume between the stiffener rib and the cylindrical structural shell.

* * * * *